US008786193B2

(12) United States Patent
Hsin

(10) Patent No.: US 8,786,193 B2
(45) Date of Patent: Jul. 22, 2014

(54) LED LAMP

(75) Inventor: Ting-Kuo Hsin, Taipei (TW)

(73) Assignee: Elementech International Co., Ltd., Taipei (TW)

( * ) Notice: Subject to any disclaimer, the term of this patent is extended or adjusted under 35 U.S.C. 154(b) by 21 days.

(21) Appl. No.: 13/612,817

(22) Filed: Sep. 12, 2012

(65) Prior Publication Data

US 2014/0070702 A1 Mar. 13, 2014

(51) Int. Cl.
*F21V 29/00* (2006.01)

(52) U.S. Cl.
USPC ..... 315/113

(58) Field of Classification Search
USPC ..... 315/113
See application file for complete search history.

(56) References Cited

U.S. PATENT DOCUMENTS 5,785,418 A * 7/1998 Hochstein ..... 362/373
7,255,460 B2 * 8/2007 Lee ..... 362/294
7,301,176 B2 * 11/2007 Abe et al. ..... 257/98
7,461,951 B2 * 12/2008 Chou et al. ..... 362/294
8,152,341 B2 * 4/2012 Wheelock et al. ..... 362/373
8,419,249 B2 * 4/2013 Yatsuda et al. ..... 362/545
8,547,002 B2 * 10/2013 Lenk et al. ..... 313/46
8,575,836 B2 * 11/2013 Van De Ven ..... 313/512
2009/0059594 A1 * 3/2009 Lin ..... 362/294
2011/0298371 A1 * 12/2011 Brandes et al. ..... 315/32
2011/0304270 A1 * 12/2011 Scarpelli ..... 315/113
2012/0051026 A1 * 3/2012 Cheng ..... 362/84
2013/0250585 A1 * 9/2013 Le Toquin et al. ..... 362/373

* cited by examiner

*Primary Examiner* — Alexander H Taningco
*Assistant Examiner* — Nelson Correa
(74) *Attorney, Agent, or Firm* — Chun-Ming Shih; HDLS IPR Services

(57) ABSTRACT

A LED lamp includes housing, a circuit layer, at least one LED die, a light-transmitting adhesive, a lamp shade, a light-transmitting liquid and the conductive connector. One end of the housing has a protrusion. The circuit layer is placed on the protrusion. The LED die is placed on the protrusion and electrically connected to the circuit layer. The light-transmitting adhesive covers the circuit layer and the light emitting die. The lamp shade including a plurality of ventilating holes is connected to the housing, and an accommodating space is cooperatively defined by the lamp shade and the housing. The light-transmitting liquid is filled within the accommodating space, and the LED die is sunk therein.

13 Claims, 5 Drawing Sheets

LED LAMP

BACKGROUND OF THE INVENTION

1. Field of the Invention

The present invention relates to a LED lamp, and in particular to a LED lamp uses liquid as thermal conductive medium.

2. Description of Prior Art

Light emitting diodes (LEDs) have the advantages of small volume, long lifetime, difficulty damage, without mercury and lower power consumption. They are gradually replacing the fluorescent tubes and incandescent lamps and widely used in indoor and outdoor lighting and decorative lighting.

However, in comparison to other lighting source, LEDs with higher power are more prone to a problem of heat dissipation. The main reason is that the heat of the LEDs cannot be dissipated through infrared radiation. Moreover, the multiple packages of the LEDs render junction thermal resistances at different junctions such that the LEDs cannot effectively dissipate heat. In general, over-temperature operation makes the LEDs reduce light output (light decay), color shift and accelerate aging to shorten the lifetime of the LEDs.

In order to solve the problems mentioned above, some manufacturers dispose fins on a housing of the LED lamp, or dispose a fan within the housing to enhance heat-dissipating capability of the LED lamp. However, the manufacturing method mentioned above enlarges the volume of the LED lamp and increase manufacturing procedures.

SUMMARY OF THE INVENTION

It is an object to provide a LED lamp, the LED lamp uses liquid as thermal conductive medium for quickly conductive heat generated from lighting LED dies.

A LED lamp includes housing, a circuit layer, at least one LED die, a light-transmitting adhesive, a lamp shade, a light-transmitting liquid and the conductive connector. One end of the housing has a protrusion. The circuit layer is placed on the protrusion. The LED die is placed on the protrusion and electrically connected to the circuit layer. The light-transmitting adhesive covers the circuit layer and the light emitting die. The lamp shade including a plurality of ventilating holes is connected to the housing, and an accommodating space is cooperatively defined by the lamp shade and the housing. The light-transmitting liquid is filled within the accommodating space, and the LED die is sunk therein.

The LED lamp of the present invention fills the light-transmitting liquid within the accommodating cooperatively defined by the housing and the lamp shade, thus the heat generated from the lighting LED die may conduct by the light-transmitting liquid, and prevent the LED die from color shift. Moreover, the ventilating holes formed on the lamp shade make air inner and outside the lamp shade convection, so as to increase heat dissipating effect and prevent the housing and the lamp shade from damaging of bearing overpressure. Furthermore, user can fill light-transmitting liquid into the accommodating space through the ventilating holes when the LED die does not sink into the light-transmitting liquid, which increases convenient of using.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Reference will now be made in detail to the present embodiments of the invention, examples of which are illustrated in the accompanying drawings.

Figure 1:
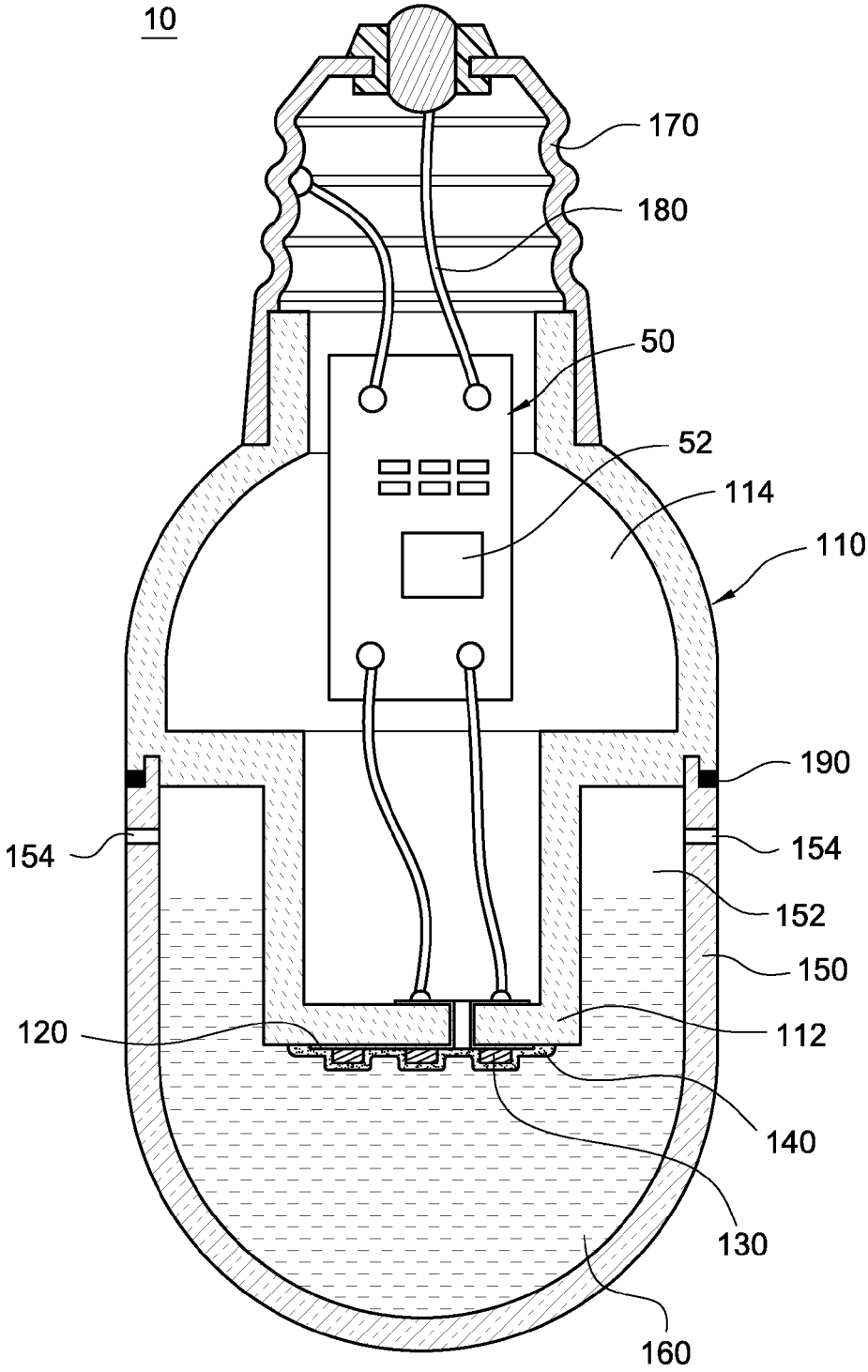
FIG. 1 is a sectional view of a light emitting diode (LED) lamp according to a first embodiment of the present invention.

Reference is made to FIG. 1, which is a sectional view of a light emitting diode (LED) lamp according to a first embodiment of the present invention. The LED lamp 10 includes housing 110, a circuit layer 120, at least one LED die 130, a light transmitting adhesive 140, a lamp shade 150, a light transmitting liquid 160 and a conductive connector 170.

The housing 110 is used for supporting the LED die 130. In this embodiment, the housing 110 is made of ceramic powder, such as aluminum oxide or silicone carbon, by sintering. The hosing 110 made of ceramic, which provides not only good thermal conductivity, but also good electrically isolating effect, thus preventing user from getting electric shock.

One end of the housing 110 has a protrusion 112. In this embodiment, the sectional profile of the protrusion 112 is of triangle shape. The housing 110 also has a cavity 114 for accommodating at least one controlling and driving circuit module 50. The controlling and driving circuit module 50 includes a plurality of electrical element 52 collectively constructing a circuit structure for controlling and driving the LED die 130. In addition, a plurality of fins (not shown) are radially extending from an external surface of the housing 110 for rapidly conducting heat generated by the LED die 130.

The circuit layer 120, made of copper, silver or other material with electrically conductive property, is placed on the protrusion 112. In this embodiment, the circuit layer 120 is formed on the protrusion 112 by thick film or thin film technology of high temperature sintering. The sintering temperature must be lower than the melting point of the ceramic housing 10.

The LED die 130 is directly placed on the protrusion 112 and electrically connected to the circuit layer 120. The amount of the LED die 130 may be one or more, and in this embodiment, the amount of the LED dies 130 is, for example, three. In additions, the LED dies 130 may emit only one color or multiple colors. In this embodiment, the LED dies 130 are placed on the protrusion 112 by chip on board technology, and electrically connected to the circuit board 120 through flip chip technique or wire bonding technique.

The light-transmitting adhesive 140 covers the circuit layer 120 and the LED dies 130, and water-tightly protects the circuit layer 120 and the LED dies 130. The light transmitting adhesive 140 may be epoxy or silicone resin.

Figure 2:
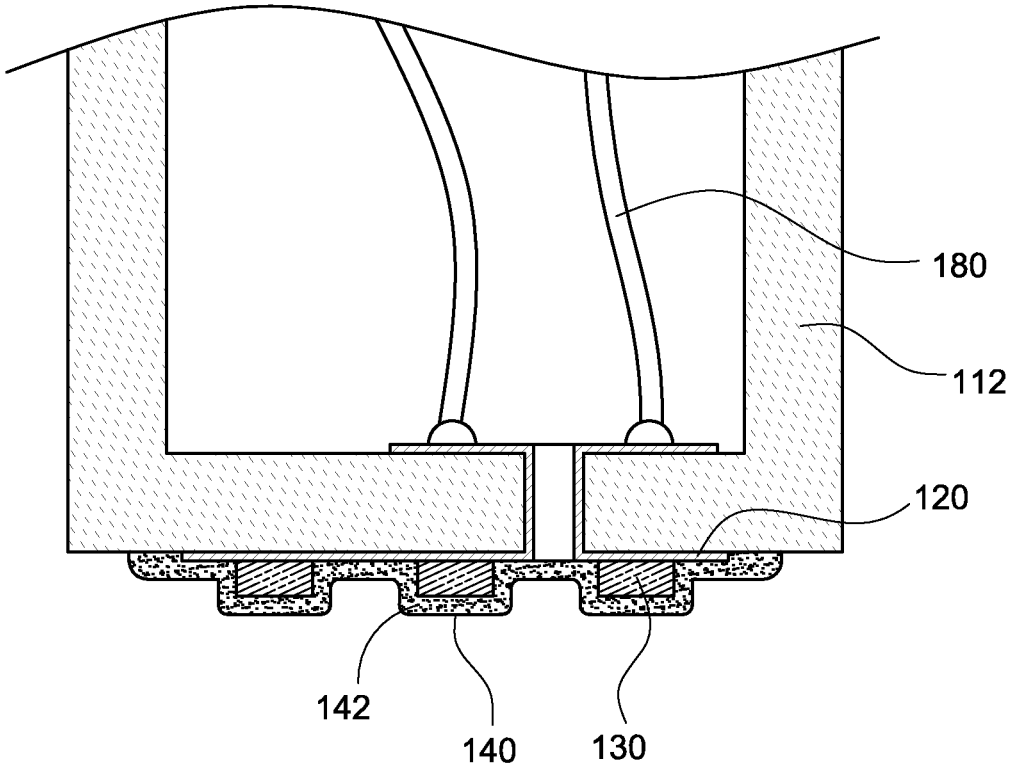
FIG. 2 is a partially enlarged view of the LED lamp according to the first embodiment of the present invention.

The light-transmitting adhesive 140 may further include a wavelength-converting matter 142, as shown in FIG. 2. The wavelength-converting matter 142 is excited by partial light emitted from the LED dies 130 and then converts the light into a wavelength-converted light, which is to be mixed with other light emitted from the LED dies 130 to generate a demanded light. In this embodiment, the light emitting from each LED dies 130 is blue, the wavelength-converted light is yellow, and the light mixed with the wavelength-converted light and other light emitted by the LED dies 130 is white.

With reference again to FIG. 1, the lamp shade 150 is connected to the housing 110, thus an accommodating space 152 is cooperatively defined by the housing 110 and the lamp shade 150. The lamp shade 150 is made of light-penetrative material, such as polycarbonate (PC for short), glass, or composed material mentioned above, and the lamp shade 150 may be selected to be transparent or translucent. In addition, the heat-resistant temperature of the lamp shade 150 is higher than or equal to 120 degrees Celsius. In this embodiment, the lamp shade 150 is of hemisphere shape. In the practical application, however, the lamp shade 150 may be of other special shape according to practical applications. The lamp shade 150 has at least one ventilating hole 154. The amount of the ventilating hole 154 may be one or more. In this embodiment, the amount of the ventilating holes 154 is, for example, two, and an aperture of each ventilating hole 154 is, for example, substantially 5 millimeters.

Figure 3:
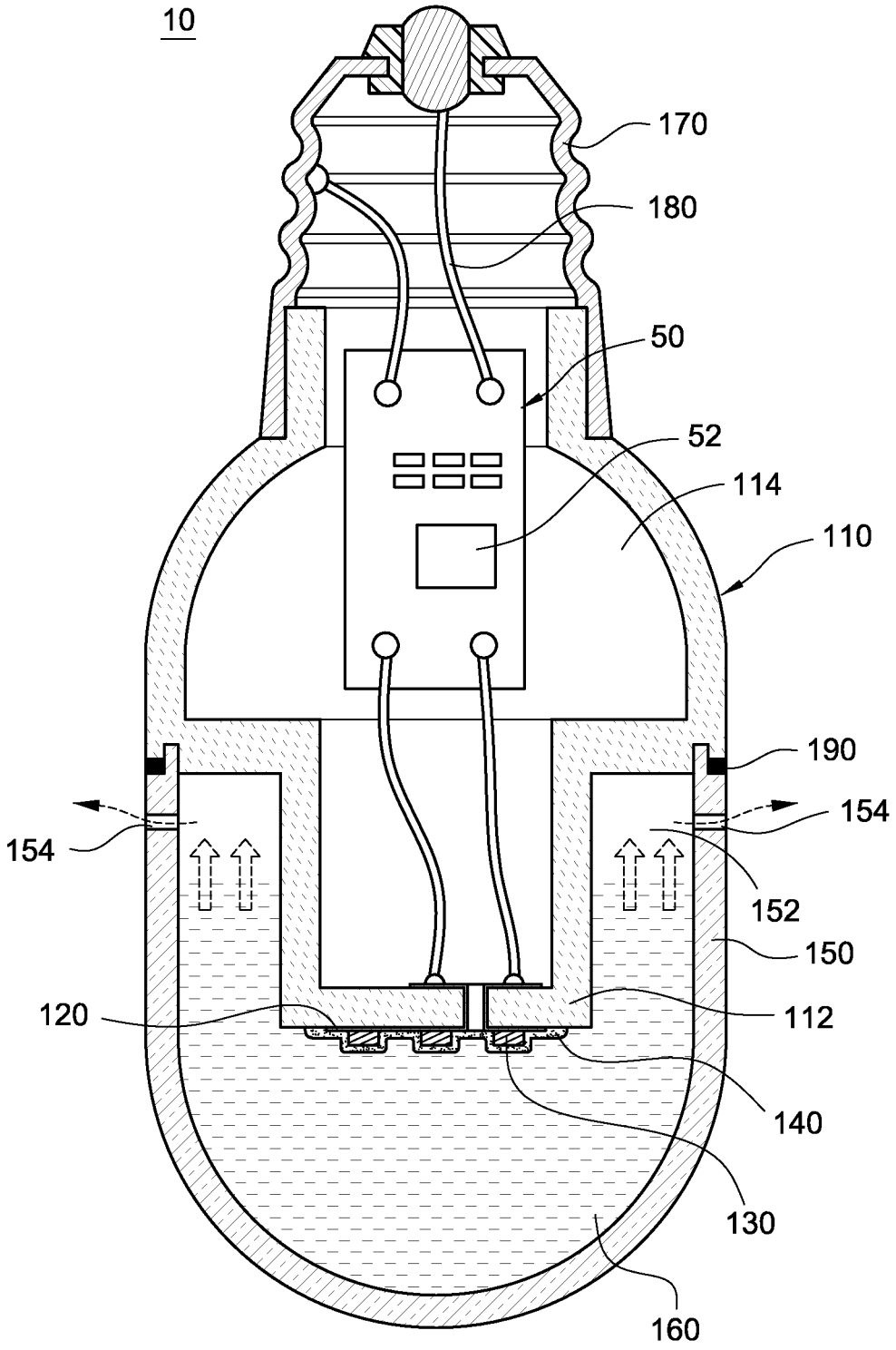
FIG. 3 is a schematic diagram of operating the LED lamp.

The light-transmitting liquid 160 may be pure water or other liquid with high thermal conductivity, and the boiling point of the light-transmitting liquid 160 must be lower than the heat resistant temperature of the lamp shade 150. The light-transmitting liquid 160 is filled within the accommodating space 152, and the protrusion 112 is at least sunk into the light-transmitting liquid 160, and the LED dies 130 are located within the light-transmitting liquid 160. Thus, the heat generated by the lighting LED dies 130 can conduct to the light-transmitting liquid 150, and lead away from the LED dies 130 through convection. In addition, vapor generated by boiled light-transmitting liquid 160 will dissipate out of the lamp shade 150 form the ventilating holes 154, as shown in FIG. 3. Thus, the heat-dissipating speed is increased and prevents the lamp shade 150 form breaking by bearing over-high vapor pressure.

Moreover, when the light-transmitting liquid 160 decrease continuously by vaporing, user can fill light-transmitting liquid 160 in reverse into the accommodating space 152. However, the volume of the light-transmitting liquid 160 filled within the accommodating space 152 should not be higher than the ventilating holes 154 to prevent the light-transmitting liquid 160 from spilling.

The conductive connector 170 is connected to another end of the housing 110. The conductive connector is adapted for screwing to a lamp holder (not shown) and for electrically connecting to an alternative power. In this embodiment, the conductive connector 170 may be, for example, E26 or E27 connector. A plurality of wires 180 are connected to the conductive connector 170, the controlling and driving module 50 and the circuit layer 120, thus the power provided by the lamp holder is electrically conducted to the controlling and driving module 50 and the circuit layer 120 through the conductive connector 170. In the practical application, the LED lamp 10 may be directly and electrically connected to alternative power through the wires 180.

The LED lamp 10 further includes a sealing ring 190 disposed at a position where the housing 110 and the lamp shade 150 are connected. The sealing ring 190 absorbs the pressure of heated light-transmitting liquid 160 with thermal expansion to prevent the housing 110 and the lamp shade 150 from damaging. The sealing ring 190 is made of elastic material such as rubber.

Figure 4:
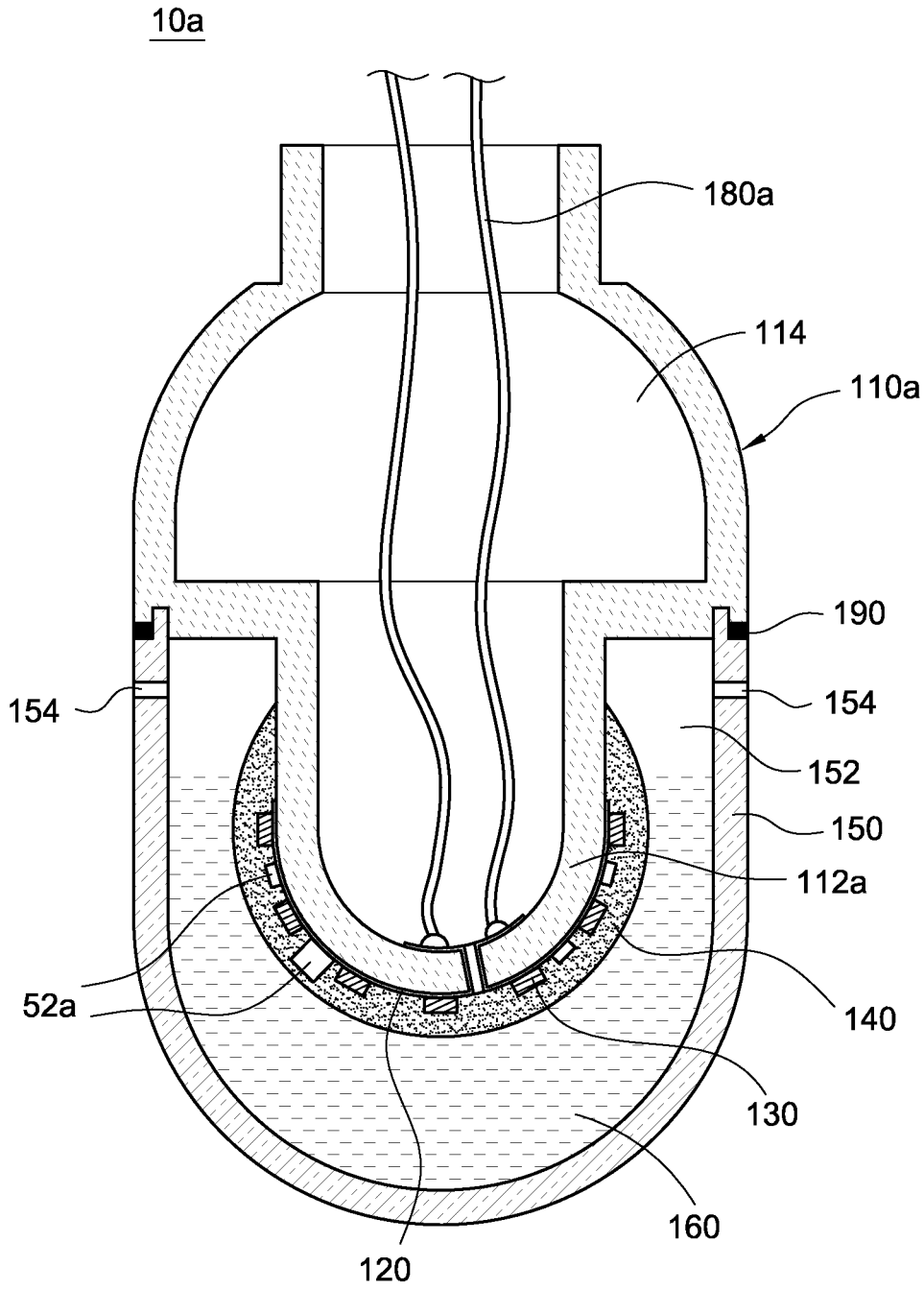
FIG. 4 is a sectional view of an LED lamp according to a second embodiment of the present invention.

Reference is made to FIG. 4, which is a sectional view of an LED lamp according to a second embodiment of the present invention. The LED lamp 10*a* is similar to the LED lamp 10 mentioned in the first embodiment, and the same reference numbers are used in the drawings and the description to refer to the same parts. It should be noted that the housing 110*a* and the electrical elements 52*a* in the FIG. 4 is different from the LED lamp 10 mentioned in the first embodiment.

The protrusion 112*a* of housing 110*a* has a profile of arc-shape, so that the extracting angle of light can be effectively enlarged, and the emission angle of the LED lamp 10*a* is more similar to that of conventional incandescent lamp.

In addition, the electrical element 52*a* for controlling and driving the LED dies 130 are placed on the protrusion 112*a* and electrically connected to the circuit layer 120. Thus, the volume of the housing 110*a* can be greatly reduced, and heat generated by the operating electrical element 52*a* is conducted away by the light-transmitting liquid 160.

Furthermore, the LED lamp 10*a* is directly and electrically connected to an alternative power for conducting power to the circuit layer 120, and driving the LED dies 130 and the electrical element 52*a*.

The function and relative description of other components of the LED lamp 10*a* are the same as that of first embodiment mentioned above and are not repeated here for brevity, and the LED lamp 10*a* can achieve the functions as the LED lamp 10 does.

Figure 5:
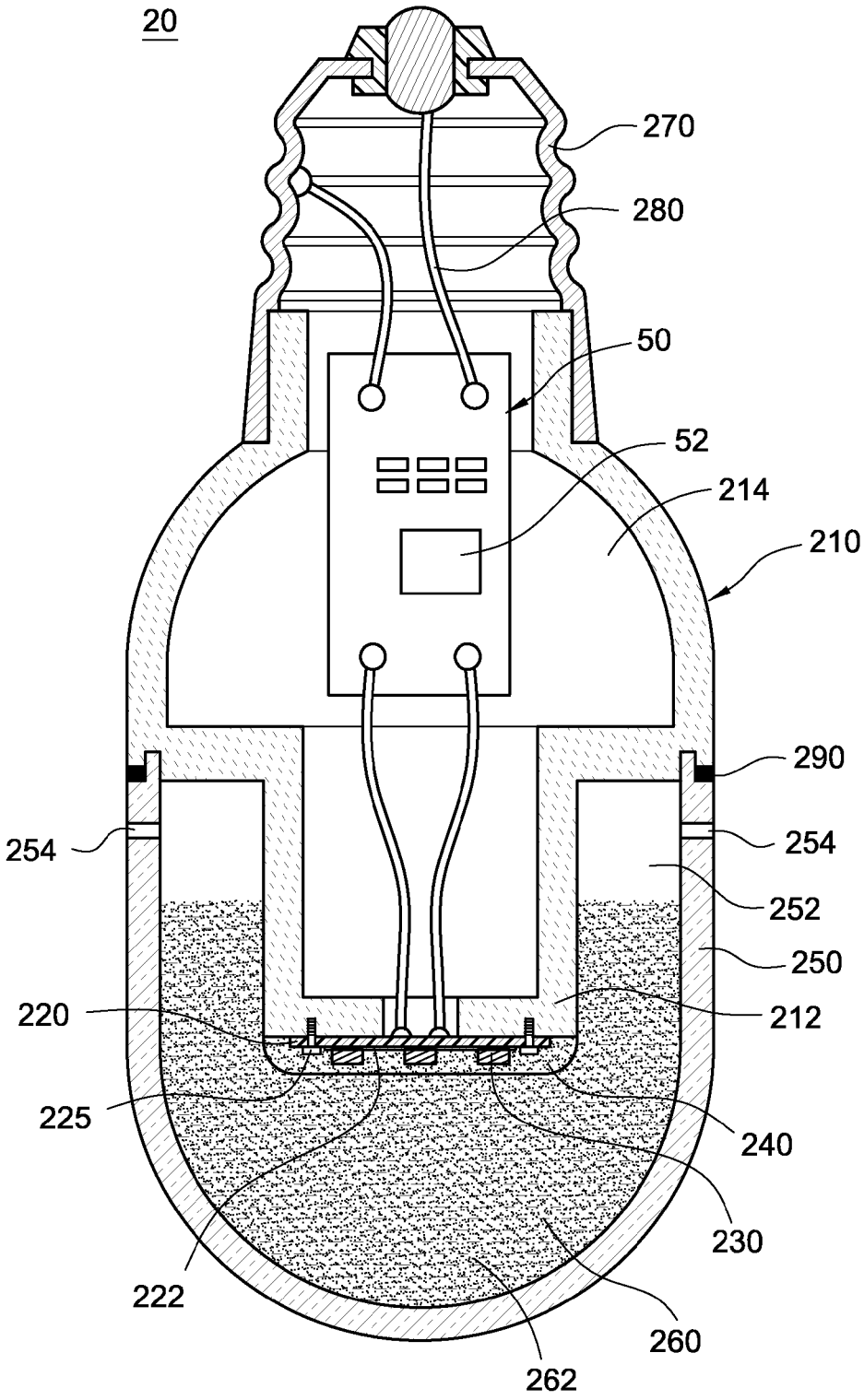
FIG. 5 is a sectional view of an LED lamp according to a third embodiment of the present invention.

Reference is made to FIG. 5, which is a sectional view of an LED lamp according to a third embodiment of the present invention. The LED lamp 20 includes a housing 210, a circuit board 220, a plurality of LED dies 230, a light-transmitting adhesive 240, a lamp shade 250, a light-transmitting liquid 260, a conductive connector 270, a plurality of wires 280 and a sealing ring 290.

The housing 210 is made of metal material such as aluminum by extrusion, which has good thermal conductive property. An end of the housing 210 has a protrusion 212.

The circuit board 220 is disposed on the protrusion 212. The protrusion 212 is used for carrying the circuit board 220 and the LED dies 230. A circuit layer 222 is disposed on the circuit board 220 in advance for electrically connected to the LED dies 230. The circuit board 220 may be printed circuit board (PCB), metal core PCB or ceramic PCB. In addition, the circuit board 220 is fastened on the protrusion 212 through a plurality of fixing elements 225, and in this embodiment, the amount of the fixing elements 225 is, for example, two.

The LED dies 230 are placed on the circuit board 220 and electrically connected to the circuit layer 222. In this embodiment, the amount of the LED dies 230 is, for example, three.

The light-transmitting adhesive 240 covers the circuit board 220, the fixing elements 225 and the LED dies 230, and water-tightly protects the circuit board 220, the fixing elements 225 and the LED dies 230. The light-transmitting adhesive 240 is preferably epoxy or silicone resin.

The lamp shade 250 is connected to the housing 210, and an accommodating space 252 is cooperatively defined by the lamp shade 250 and the housing 210. The lamp shade 250 is made of light-penetrative material, and the heat-resistant temperature thereof is higher than 120 degree Celsius. A plurality of ventilating holes 254 is formed on the lamp shade 250 and adjacent to the housing 210. The light-transmitting liquid 260 is filled within the accommodating space 252 and does not higher than the ventilating holes 254.

The light-transmitting liquid 260 may further includes a wavelength-converting matter 262 for converting light passing therethrough, so that the LED lamp 20 can emit the corresponding color.

The sealing ring 290 is made of elastic material and disposed at a position where the housing 210 and the lamp shade

250 are connected for absorbing pressure of the heated light-transmitting liquid 260 with thermal expansion.

The conductive connector 270 is connected to another end of the housing 210. The conductive connector 270 is adapted for screwing to a lamp holder (not shown) and for electrically connecting to an alternative power. The wires 280 is electrically connected between the controlling and driving module 50, the conductive connector 270 and the circuit board 220 for conducting power therebetween. The controlling and driving module 50 includes a plurality of electrical elements 52 for driving and controlling the LED dies 230 to turn on or turn off, and controlling the operating conditions. In the practical application, the wires 280 can directly electrically connected to the alternative power.

To sum up, the LED lamp of the present invention fills the light-transmitting liquid within the accommodating cooperatively defined by the housing and the lamp shade, thus the heat generated from the lighting LED dies may conduct by the light-transmitting liquid, and prevent the LED dies from color shift. Moreover, the ventilating holes formed on the lamp shade make air inner and outside the lamp shade convection, so as to increase heat dissipating effect and prevent the housing and the lamp shade from damaging of bearing over-pressure. Furthermore, user can fill light-transmitting liquid into the accommodating space through the ventilating holes when the LED dies do not sink into the light-transmitting liquid, which increases convenient of using.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A light emitting diode (LED) lamp comprising:

a housing, an end of the housing comprising a protrusion;

a circuit layer placed on the protrusion;

at least one LED die placed on the protrusion and electrically connected to the circuit layer;

a light transmitting adhesive covering the circuit layer and the LED die;

a lamp shade connected to housing, the lamp shade and the housing cooperatively defined an accommodating space, the lamp shade comprising a plurality of ventilating holes; and a light transmitting liquid fill within the accommodating space and the LED die sunk in the light transmitting liquid, wherein the ventilating holes are configured to dissipate vapor generated by boiled light transmitting liquid to increase a heat dissipating speed and prevent the lamp shade from breaking by bearing over high vapor pressure, and the light transmitting liquid is refillable in reverse into the accommodating space through the ventilating holes, and wherein the ventilating holes are higher than a level bare of the light transmitting liquid when the LED lamp in operation.

2. The LED lamp in claim 1, wherein the heat-resistant temperature of the lamp shade is higher than 120 degrees Celsius.

3. The LED lamp in claim 1, wherein an aperture of each ventilating hole is 5 millimeters.

4. The LED lamp in claim 2, wherein the lamp shade is made of polycarbonate or glass.

5. The LED lamp in claim 1, wherein a profile of the protrusion is substantially of triangle shape.

6. The LED lamp in claim 1, wherein a profile of the protrusion is of arc-shape.

7. The LED lamp in claim 1, further comprising a wavelength-converting matter disposed within the light transmitting adhesive.

8. The LED lamp in claim 1, further comprising a sealing ring disposed at the position where the housing and the lamp shade connected.

9. The LED lamp in claim 1, further comprising a plurality of wires electrically connected to the circuit layer.

10. The LED lamp in claim 1, wherein the housing is made of ceramic powder by sintering.

11. The LED lamp in claim 1, further comprising a controlling and driving module disposed within the housing and electrically connected to the circuit layer, the controlling and driving module comprises a plurality of electrical elements.

12. The LED lamp in claim 1, further comprising a plurality of electrical elements placed on the protrusion and electrically connected to the circuit layer, the light-transmitting adhesive simultaneously covers the electrical elements.

13. The LED lamp in claim 9, further comprises a conductive connector disposed on another side of the housing, the wires connected to the conductive connector and the circuit layer.

* * * * *